United States Patent [19]

Saunders

[11] Patent Number: 4,631,871

[45] Date of Patent: Dec. 30, 1986

[54] ABRASIVE FLUID JET APPARATUS

[75] Inventor: David H. Saunders, Cranfield, England

[73] Assignee: Fluid Engineering Products Limited, Milton Keynes, England

[21] Appl. No.: 568,204

[22] PCT Filed: Apr. 18, 1983

[86] PCT No.: PCT/GB83/00111

§ 371 Date: Dec. 12, 1983

§ 102(e) Date: Dec. 12, 1983

[87] PCT Pub. No.: WO83/03557

PCT Pub. Date: Oct. 27, 1983

[30] Foreign Application Priority Data

Apr. 19, 1982 [GB] United Kingdom ..... 8211224

[51] Int. Cl.[4] ..... B24C 5/04

[52] U.S. Cl. ..... 51/439; 51/321

[58] Field of Search ..... 51/410, 439, 319–321

[56] References Cited

U.S. PATENT DOCUMENTS 2,440,643 4/1948 Pettinos .

3,055,149 9/1962 Luce ..... 51/428

FOREIGN PATENT DOCUMENTS 0735384 11/1932 France .

*Primary Examiner*—Frederick R. Schmidt

*Assistant Examiner*—Robert A. Rose

*Attorney, Agent, or Firm*—Shapiro and Shapiro

[57] ABSTRACT

A carrier fluid with entrained particulate solid material (14), for abrasive purposes, is fed through an inlet (12) in a housing (3) so as to follow a spiral path, thereby preventing the particulate solid material (14) from settling under the influence of gravity. The housing (3) defines a transfer space (5) which is bounded, in part, by a first end (18) and a second end (20) of the housing (3). The fluid with the entrained particulate solid material (14) is deflected inwardly by the inner surfaces (15 and 16) of the first and second ends (18 and 20) of the housing (3) into a liquid jet (11) issuing from a jetting nozzle (9) in the first end (18) of the housing (3). The particulate solid material (14) is thereby entrained in the outer layer of the jet (11) issuing from an outlet aperture (8) in the second end (20) of the housing (3), thus enabling the jet (11) to be used for cutting or cleaning purposes.

10 Claims, 3 Drawing Figures

ABRASIVE FLUID JET APPARATUS

TECHNICAL FIELD

The invention relates to an abrasive fluid jet apparatus in which particulate solid material is entrained in a fluid jet for the purpose of improving the cutting and/or cleaning ability of the jet.

BACKGROUND ART

One known form of dispenser for a jet of fluid bearing particulate abrasive material, disclosed in UK Patent Specification No. 1 569 736, comprises housing means defining a transfer space; outlet means defining an outlet aperture extending from the transfer space; and jetting nozzle means for directing a fluid through the transfer space and the outlet aperture in a jet.

However, in this known form of apparatus, the particulate solid material is fed into the transfer space in a dry condition along passages extending convergently with the axis of the jet, the dry particulate solid material being drawn into the transfer space as a result of suction caused by the jet passing through the transfer space. Thus, even where great care is taken in the design and manufacture of apparatus such as this, there is a tendency for the dry particulate solid material to clog and thereby cause variations in the amount of particulate solid material entrained in the jet.

DISCLOSURE OF THE INVENTION

The purpose of the present invention is to provide an abrasive fluid jet apparatus which is less difficult to design and manufacture and in which particulate solid material is entrained in the fluid jet at a more uniform rate than in known apparatus.

This is achieved by providing inlet means for directing a carrier fluid, in which the particulate solid material is entrained, along a spiral path within the transfer space and guide means for conducting the carrier fluid with the entrained particulate solid material through the transfer space towards the jet for entraining the particulate solid material in the outer layer of the jet.

The invention therefore provides an abrasive fluid jet apparatus comprising housing means defining a transfer space; inlet means for directing a carrier fluid with entrained particulate solid material along a spiral path within the transfer space; outlet means defining an outlet aperture extending from the transfer space; jetting nozzle means for directing a fluid through the transfer space and through the outlet aperture in a jet; guide means for conducting the carrier fluid with the entrained particulate solid material through the transfer space towards the jet for entraining the particulate solid material in the outer layer of the jet.

Thus, by entraining the particulate solid material in a carrier fluid and providing means for directing this carrier fluid along a spiral path, it is possible to maintain a constant concentration of solid particulate material in the carrier fluid entrained in the outer layer of the jet.

Conveniently, a housing encloses the transfer space and has first and second ends respectively surrounding the jetting nozzle means and the outlet means and a connecting wall extending between the first and the second ends; and the guide means comprise inner surfaces of the transfer space which deflect the carrier fluid with the entrained particulate solid material in the transfer space radially inwards towards the axis of the jet.

Thus, in one embodiment according to the invention, the transfer space is bounded by the first and second ends and the connecting wall.

In a preferred form of the invention, for use with a particulate solid material which is denser than the carrier fluid, the outlet means comprise a tubular member extending from within the housing; and the transfer space is bounded, in part, by the tubular member, the connecting wall and the second end of the housing. The inner surface of the first end may be shaped so as to facilitate the movement of the particulate solid material towards the jet and is preferably frusto-conical in shape.

With this form of apparatus, particulate solid material is concentrated towards the outer portion of the transfer space, as a result of centrifugal force, whereas the carrier fluid is concentrated towards the central portion of the transfer space. However, as a result of secondary flow within the converging portion of the transfer space which is bounded, in part, by the frusto-conical inner surface of the first end of the housing, the particulate solid material is concentrated around the jet to facilitate entrainment of the particulate solid material in the outer layer of the jet and the carrier fluid is discharged from the transfer space in the form of a curtain which surrounds the fluid jet and its entrained particulate solid material, thus providing a protective barrier between the particulate solid material and the outlet means to prevent or reduce abrasive wear of the outlet means. Alternatively, the carrier fluid can be vented directly to atmosphere through vents in the second end of the housing.

The momentum of the carrier fluid with the entrained particulate solid material flowing in the spiral path is very low compared with that of the fluid in the jet (typically less than 0.5%) so that the swirl it produces is dissipated within the outlet means.

MODES FOR CARRYING OUT THE INVENTION

Figure 1:
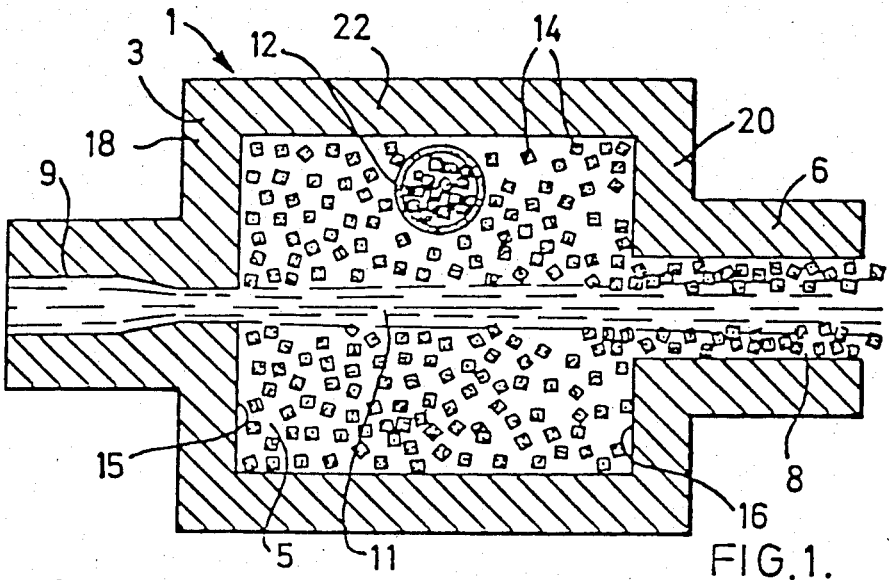
FIG. 1 is a schematic half-sectional side elevation of a first abrasive fluid jet apparatus embodying the invention.

In the first embodiment 1 of the invention, illustrated in FIG. 1, jetting nozzle means, in the form of a single jetting nozzle 9 direct a jet of fluid 11 through an outlet aperture 8.

Inlet means 12 extend tangentially into a transfer space 5 within the housing 3. Carrier fluid, such as water, with entrained particulate solid material, such as particles of sand, is therefore directed into the transfer space 5 so as to flow along a spiral path. Clearly, it is not necessary for the inlet 12 to extend perfectly tangentially; all that is necessary is that the inlet 12 extends along an axis which has at least a component extending tangentially of the transfer space 5. Similarly, although it is preferred that the transfer space 5 should be of circular cross-section, the cross-section may be non-circular.

Carrier fluid with entrained particulate solid material 14 is directed towards the central axis of the transfer space 5 where it is entrained in the outer layer of a jet extending from the jetting nozzle 9 and through the transfer space 5 and the outlet aperture 8.

The apparatus 1 thus ensures that the concentration of particulate solid material 14 in the carrier fluid fed to the jet 11 remains constant and is uniformly entrained in the outer layer of the jet 11.

In this embodiment of the invention, the transfer space 5 is enclosed by a housing 3 having a first end 18 surrounding jetting nozzle means in the form of a jetting nozzle 9, and a second end 20 surrounding outlet means in the form of an outlet nozzle 6.

Carrier fluid with entrained particulate solid material 14 is fed into the housing 3 through inlet means 12 adjacent a connecting wall 22 extending between the first end 18 and the second end 20 so as to direct the carrier fluid with the entrained particulate solid material 14 along a spiral path within the transfer space 5. Guide means, in the form of the inner surfaces 15 and 16 of the first end 18 and the second end 20 conduct the carrier fluid with the entrained particulate solid material 14 radially inwards into contact with the jet 11 issuing from the jetting nozzle 9 so that the particulate material 14 is entrained in the outer layer of the jet 11 which issues from the outlet nozzle 6.

Figure 2:
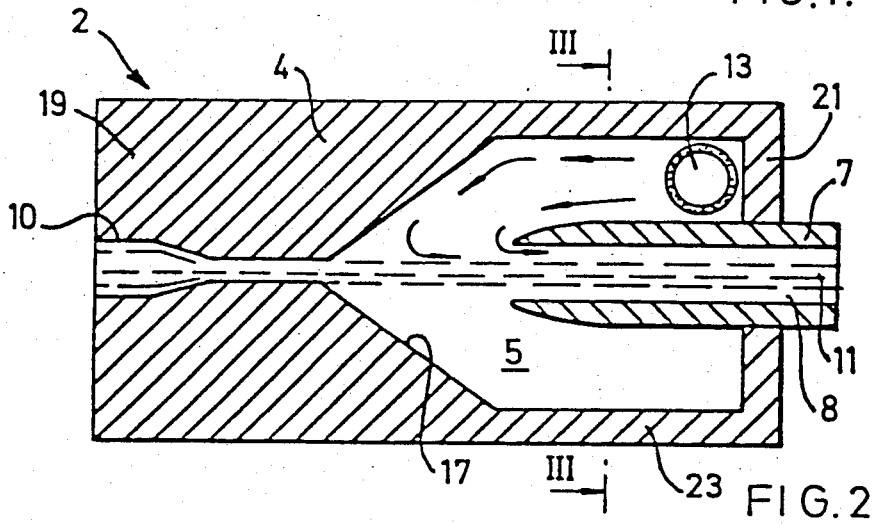
FIG. 2 is a sectional side elevation of a second abrasive fluid jet apparatus embodying the invention.
Figure 3:
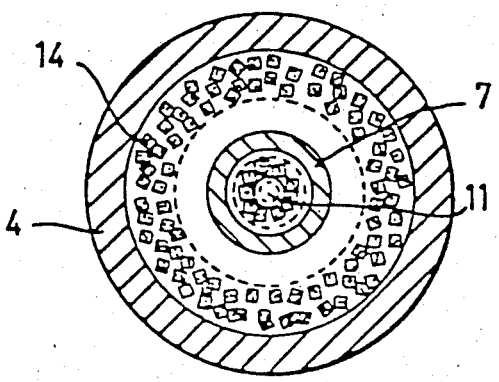
FIG. 3 is a sectional end elevation across the Section III—III in FIG. 2.

In the second embodiment 2, illustrated in FIGS. 2 and 3 of the drawings, the transfer space 5 is again enclosed within a housing 4 having a first end 19 surrounding jetting nozzle means in the form of a jetting nozzle 10 and a second end 21 surrounding outlet means in the form of an outlet tube 7 extending from the transfer space 5 to beyond the second end 21 of the housing 4. A connecting wall 23 extends between the first end 19 and the second end 21 of the housing 4. The outlet tube 7 defines an outlet aperture 8 having a cross-section larger than that of a fluid jet 11 issuing from the jetting nozzle 10. However, in this case, the inlet means 13 are disposed adjacent the second end 21 of the housing 4 so as to direct a carrier fluid with entrained particulate solid material 14 along a spiral path in the transfer space 5 which is bounded, in part, by the second end 21 of the housing 4.

The carrier fluid with the entrained particulate solid material 14 is conducted by guide means in the form of a frusto-conical inner surface 17 of the first end 19 of the housing 4 which direct the carrier fluid and the entrained particulate solid material 14 radially inwards into a fluid jet 11 issuing from the jetting nozzle 10. However, where the particulate solid material 14 is more dense than the carrier fluid, centrifugal separation causes an increase in the concentration of the particulate solid material 14 in the carrier fluid fed into the upstream portion of the jet 11 and a decrease in the concentration of the particulate solid material 14 in the carrier fluid fed into the downstream portion of the jet 11 passing through the transfer space 5. As will be appreciated from the drawing, with the jet entrance to the outlet aperture positioned at least about half-way down the length of the transfer space from the jet inlet, as shown, the carrier fluid forms a protective screen between the inner surface of the outlet tube 7 and the outer layer of the jet 11 in which the particulate solid material 14 is entrained.

I claim:

1. Abrasive fluid jet apparatus comprising housing means defining a transfer space, outlet means defining an outlet aperture through an outlet end of said transfer space, jetting nozzle means at an inlet end of said transfer space for directing a fluid jet axially through said space toward said outlet aperture, inlet means spaced downstream of said jetting nozzle means for introducing a carrier fluid with entrained abrasive particulate solid material substantially tangentially into said transfer space so that said particulate flows along a sprial path, said particulate material being more dense than said carrier material so as to be substantially separable therefrom by centrifugal force, and guide means within said transfer space for causing said particulate material to concentrate more heavily toward said inlet end of said space than toward said outlet end and for causing carrier fluid with a high concentration of said particulate material to flow radially inward of said space near said inlet end and carrier fluid with a low concentration of said particulate material to flow radially inward of said space downstream from said high concentration, said guide means including an internal frusto-conical wall of said housing disposed at said inlet end of said transfer space and tapering inward toward said jetting nozzle means from downstream of said jetting nozzle means to facilitate the radial inward flow of said carrier fluid with a high concentration of said particulate material, whereby said particulate material becomes entrained in an outer layer of said fluid jet mainly toward said inlet end and a further layer composed principally of said carrier fluid forms around said outer layer of said jet.

2. Apparatus in accordance with claim 1, wherein said guide means includes another internal end wall of said housing means disposed at said outlet end of said transfer space and a further internal wall of said housing means connecting said end walls of said housing means.

3. Apparatus in accordance with claim 2, wherein said outlet means comprises a tube extending from within said transfer space through said end wall at said outlet end of said transfer space.

4. Apparatus in accordance with claim 3, wherein said inlet means is positioned adjacent said end wall at said outlet end of said transfer space.

5. A method of forming an abrasive jet, comprising providing housing means defining a transfer space having an inlet end and an outlet end with an outlet aperture therein, directing a fluid jet axially through said transfer space from said inlet end and through said outlet aperture, introducing a carrier fluid with entrained abrasive particulate solid material having greater density than said carrier fluid substantially tangentially into said transfer space at a location spaced downstream from said inlet end so that said particulate material flows along a spiral path and substantially separates from said carrier material by centrifugal force, and guiding said abrasive particulate material within said transfer space so that said abrasive particulate material concentrates more heavily toward said inlet end than toward said outlet end and so that carrier fluid with a high concentration of said abrasive particulate material flows radially inward of said space near said inlet end and carrier fluid with a low concentration of said abrasive particulate material flows radially inward of said space downstream from said high concentration, said guiding including directing the carrier fluid with a high concentration of said abrasive particulate radially inward with a frustro-conical internal end wall of said housing disposed at said inlet end of the transfer space and tapering inward away from said outlet end, whereby said particulate material becomes entrained in an outer layer of said fluid jet mainly toward said inlet end and a further layer composed principally of said carrier fluid forms around said outer layer of said fluid jet.

6. Abrasive fluid jet apparatus comprising housing means defining a transfer space having an inlet end and an outlet end, outlet means defining an outlet aperture through said outlet end of said transfer space, jetting nozzle means at said inlet end of said transfer space for directing a fluid jet axially through said space toward an entrance of said outlet means which is space downstream from said jetting nozzle means by at least about half the length of said transfer space, inlet means spaced downstream of said jetting nozzle means for introducing a carrier fluid with entrained particulate solid material substantially tangentially into said transfer space so that said particulate flows along a spiral path, said particulate material being more dense than said carrier material so as to be substantially separable therefrom by centrifugal force, and guide means within said transfer space for causing said particulate material to concentrate more heavily toward said inlet end of said space than toward said outlet end and for causing carrier fluid with a high concentration of said particulate material to flow radially inward of said space near said inlet end and carrier fluid with a low concentration of said particulate material to flow radially inward of said space downstream from said high concentration, whereby said particulate material becomes entrained in an outer layer of said fluid jet mainly toward said inlet end and a further layer composed principally of said carrier fluid forms around said outer layer of said jet more toward said entrance of said outlet means.

7. Apparatus in accordance with claim 6, wherein said guide means includes internal end walls of said housing means respectively disposed at said inlet and outlet ends of said transfer space and a further internal wall of said housing means connecting said end walls.

8. Apparatus in accordance with claim 7, wherein said outlet means comprises a tube extending from within said transfer space through said end wall at said outlet end of said transfer space and wherein said end wall at said inlet end of said transfer space has a frustroconical configuration converging toward said jetting nozzle means.

9. Apparatus in accordance with claim 8, wherein said inlet means is positioned adjacent said end wall at said outlet end of said transfer space.

10. A method of forming an abrasive jet, comprising providing housing means defining a transfer space having an inlet end and an outlet end with outlet means defining an outlet aperture through said outlet end and having an entrance spaced axially from said inlet end by at least about half the length of said transfer space, directing a fluid jet axially through said transfer space from said inlet end and through said outlet means, introducing a carrier fluid with entrained abrasive particulate solid material having greater density than said carrier fluid substantially tangentially into said transfer space at a location spaced downstream from said inlet end so that said particulate material flows along a spiral path and substantially separates from said carrier material by centrifugal force, and guiding said abrasive particulate material within said transfer space so that said abrasive particulate material concentrates more heavily toward said inlet end than toward said outlet end and so that carrier fluid with a high concentration of said abrasive particulate material flows radially inward of said space near said inlet end and carrier fluid with a low concentration of said abrasive particulate material flows radially inward of said space downstream from said high concentration, whereby said abrasive particulate material becomes entrained in an outer layer of said fluid jet mainly toward said inlet end and a further layer composed principally of said carrier fluid forms around said outer layer of said jet more toward said outlet end.

* * * * *